US005944386A

United States Patent [19]

Yamagishi et al.

[11] Patent Number: 5,944,386

[45] Date of Patent: Aug. 31, 1999

[54] ARMREST DEVICE FOR CHAIR

[75] Inventors: Hideyuki Yamagishi; Masayuki Ozawa; Naokuni Nakata; Kohichi Ogura, all of Iruma, Japan

[73] Assignee: Plus Corporation, Tokyo, Japan

[21] Appl. No.: 09/175,288

[22] Filed: Oct. 20, 1998

[30] Foreign Application Priority Data

Feb. 13, 1998 [JP] Japan ..... 10-030785

[51] Int. Cl.[6] ..... A47C 7/54

[52] U.S. Cl. ..... 297/411.31; 297/411.38; 297/411.37

[58] Field of Search ..... 297/411.31, 411.35, 297/411.38, 161, 173, 411.37; 248/292.12

[56] References Cited

U.S. PATENT DOCUMENTS

| | | | |
|---|---|---|---|
| 4,429,918 | 2/1984 | Alsup, Jr. et al. | 297/411.31 |
| 4,452,387 | 6/1984 | Plowman | 297/411.35 |
| 5,599,067 | 2/1997 | Schulke et al. | 297/411.35 X |
| 5,641,203 | 6/1997 | Van De Riet et al. | 297/411.38 |
| 5,655,814 | 8/1997 | Gibbs | 297/411.38 |
| 5,749,628 | 5/1998 | Snyder et al. | 297/411.31 |

FOREIGN PATENT DOCUMENTS 9-299186 11/1997 Japan .

*Primary Examiner*—Anthony D. Barfield
*Attorney, Agent, or Firm*—Darby & Darby

[57] ABSTRACT

An attaching cylinder 6 is disposed on an armrest main body 5. A main shaft 3 is disposed uprightly on an upper end of a support 2 and rotatably combined with the attaching cylinder 6 inside the attaching cylinder 6. A guiding portion 8A is disposed on an upper end of the main shaft 3 which protrudes from an upper end of the attaching cylinder 6. A guiding surface 8*a* is disposed on the guiding portion 8A along a circle formed with the main shaft 3 as a center. A supporting piece rotation-urged toward the guiding surface at a distal end portion thereof and attached rotatably to the armrest main body around the longitudinal axis at a proximal end portion thereof. A roller 14 is disposed on a distal end portion of the supporting piece and rolls on the guiding surface 8*a*. Receiving recess portions 11A, 11B, 11C, 11D, 11E, 11F, disposed at suitable locations of the guiding surface 8, with which the roller 14 is engaged or disengaged.

3 Claims, 5 Drawing Sheets

ARMREST DEVICE FOR CHAIR

BACKGROUND OF THE INVENTION

1. Field of the Invention

The present invention relates to an armrest device for a chair (generally, an office chair) which is capable of changing a direction of an armrest of the chair.

2. Prior Art

There has been proposed an armrest device for a chair, e.g. by Japanese Provisional Patent Publication (Kokai) No. 9-299186, which comprises a support for an armrest, a pair of fore and rear fixed supporting shafts disposed on the support, a pair of front and rear guiding grooves disposed on the armrest for engaging with the fixed supporting shaft, respectively. On this occasion, the fore guiding groove comprises two continuous grooves oriented in two directions, and the rear guiding groove is formed linearly in the longitudinal direction.

According to the prior art, the longitudinal moving position of the armrest is regulated depending on the engagement relationship between the rear fixed supporting shaft and the rear guiding groove. The armrest is moved forward while engaging one of the fore guiding grooves with the fore fixed supporting shaft, thereby causing the armrest to be automatically rotated with the rear fixed supporting shaft as a center, which causes the direction of the armrest to be changed.

According to the prior art, changing the direction of the armrest requires to move the armrest longitudinally; therefore, changing the direction of the armrest e.g. from the right side to the left side requires to move the armrest rearward at once, and then forward again (simultaneously, the armrest is rotated). This makes the armrest direction changing operation troublesome.

SUMMARY OF THE INVENTION

It is therefore an object of the invention to provide an armrest device for a chair, which is capable of changing the direction of the armrest merely by the rotation operation, and then has an inventive construction for use in the operation.

To attain the above object, according to the invention, there is provided an armrest device for a chair, comprising:

a support;

an attaching cylinder disposed on an armrest main body;

a main shaft disposed uprightly on an upper end of the support and rotatably combined with the attaching cylinder inside the attaching cylinder;

a guiding portion disposed on an upper end of the main shaft which protrudes from an upper end of the attaching cylinder;

a guiding surface disposed on the guiding portion along a circle formed with the main shaft as a center;

a swinging piece rotation-urged toward the guiding surface at a distal end portion thereof and attached rotatably to the armrest main body around the longitudinal axis at a proximal end portion thereof;

a contacting portion disposed on a distal end portion of the swinging piece and moving on the guiding surface; and receiving recess portions, disposed at suitable locations of the guiding surface, with which the contacting portion is engaged or disengaged.

Preferably, the contacting portion comprises a roller, which is capable of rolling on the guiding surface, rotatably attached to the distal end portion of the swinging piece.

In a preferred embodiment of the invention, the armrest device for the chair further comprises a notch disposed on the guiding portion so as to communicate with a portion of a lower surface of the guiding portion surrounding the main shaft by perforating a distal end portion of the armrest main body, a regulating piece engaged with the notch at one end thereof due to an urging force of a spring, and an operating piece combined to the armrest main body movably in the longitudinal direction so as to protrude from a lower surface of the armrest main body at a lower end portion thereof, wherein an intermediate portion of the regulating piece is attached to the armrest main body rotatably around the lateral axis, and the other end of the regulating piece and an upper end portion of the operating piece are rotatably combined to each other.

In a preferred another embodiment of the invention, the armrest device for the chair further comprises an engaging piece fixed to the armrest main body and overlapping with the lower surface of the guiding portion, and a receiving/supporting portion disposed just below the guiding portion, and having a first receiving/supporting edge for catching one end surface of the engaging piece in such a side as that the engaging piece moves due to the rotation of the armrest main body, and a second receiving/supporting edge of catching the other end surface of the engaging piece opposed to the one end surface of the engaging piece.

According to the present invention, rotating the armrest main body with the main shaft as center causes the contacting portion to be moved while contacting to the guiding surface disposed on the upper end of the main shaft, and then to be engaged with suitable one of the receiving recess portions disposed on the guiding surface, which enables the direction of the armrest main body to be changed. Therefore, merely rotating the armrest main body enables the direction of the armrest to be freely changed. Also, arranging the receiving recess portions at suitable angular locations enables the selected angular location of the armrest to be kept, which provides a preferable armrest of practical use.

Moreover, the contacting portion comprises a roller rolling on the guiding surface, which enables the contacting portion to be smoothly moved on the guiding surface without generating a noise.

According to the above preferred embodiment of the invention, the armrest main body can be surely positioned at a set position (oriented in a direction parallel with the longitudinal direction of the seat). According to the above another embodiment of the invention, the armrest can be prevented from being rotated in the clockwise and counterclockwise direction.

The above and other objects, features, and advantages of the invention will be more apparent from the following detailed description taken in conjunction with the accompanying drawings.

DETAILED DESCRIPTION OF THE PREFERRED EMBODIMENT

Figure 1:
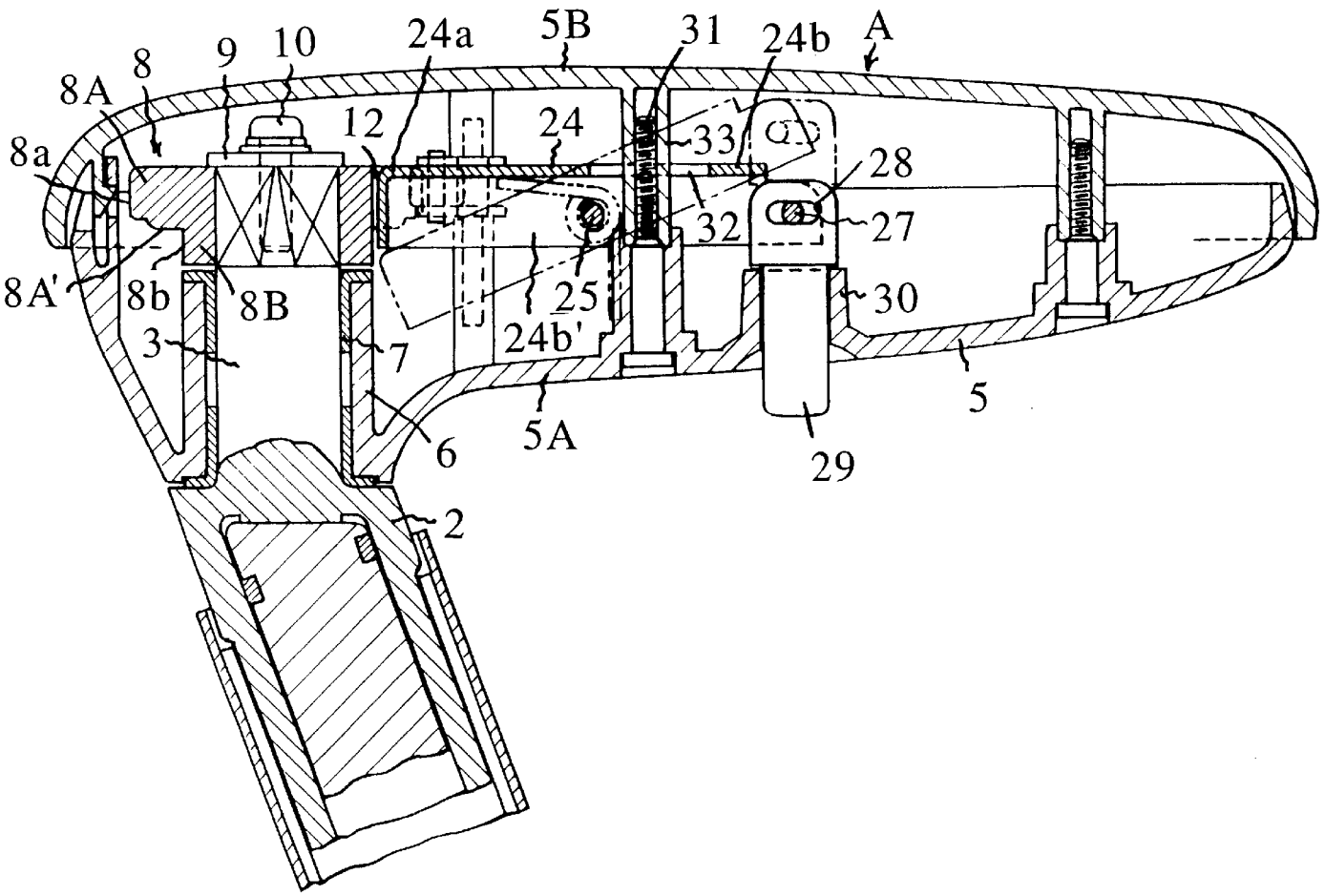
FIG. 1 is a longitudinal section of an armrest device for a chair according to an embodiment of the invention, from which an engaging piece is omitted.
Figure 2:
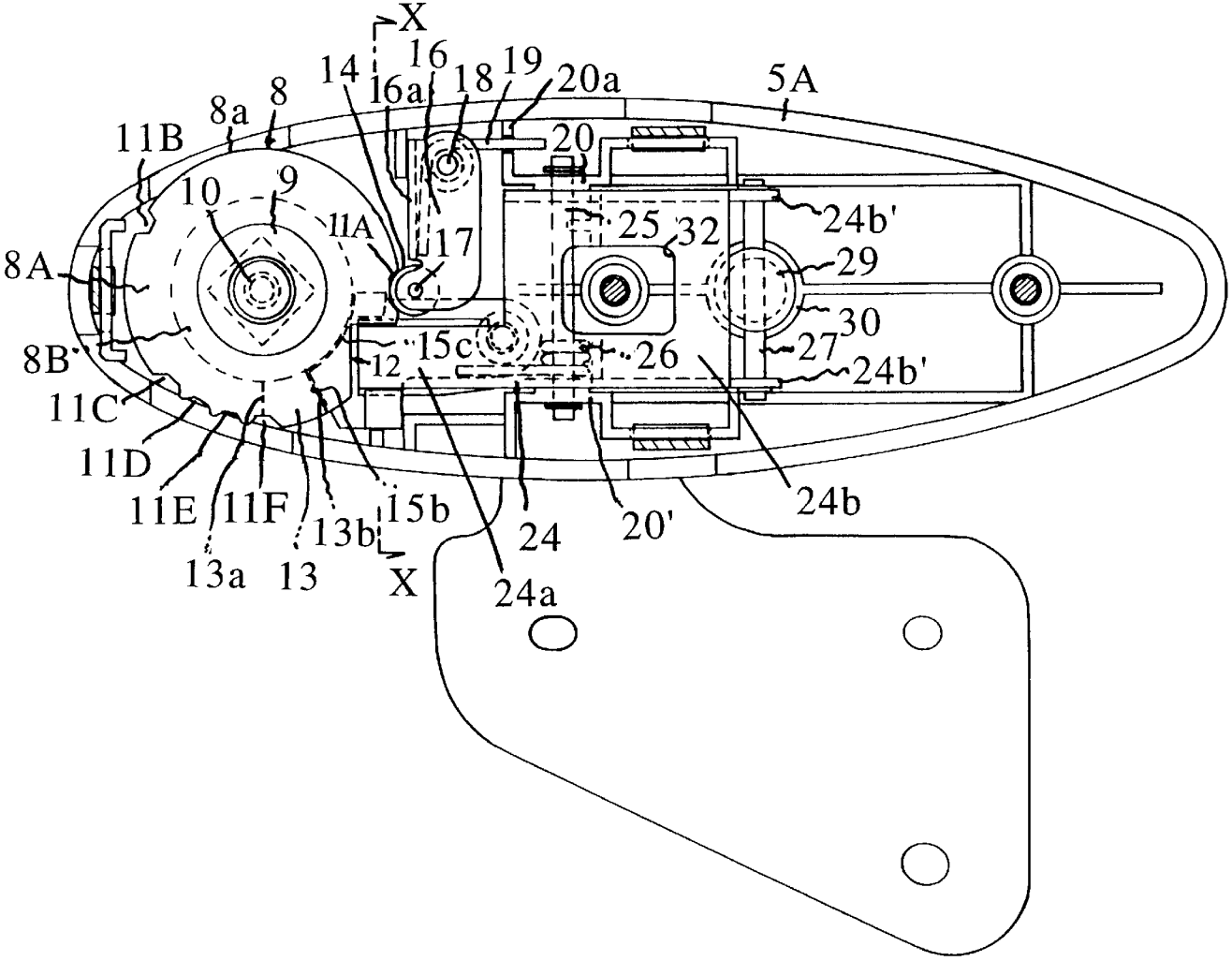
FIG. 2 is a plan view of a main part of an armrest device for a chair according to the embodiment of the invention.
Figure 3:
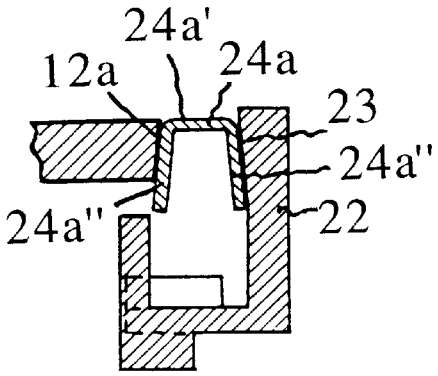
FIG. 3 is a sectional view taken on line X—X in FIG. 2.
Figure 4:
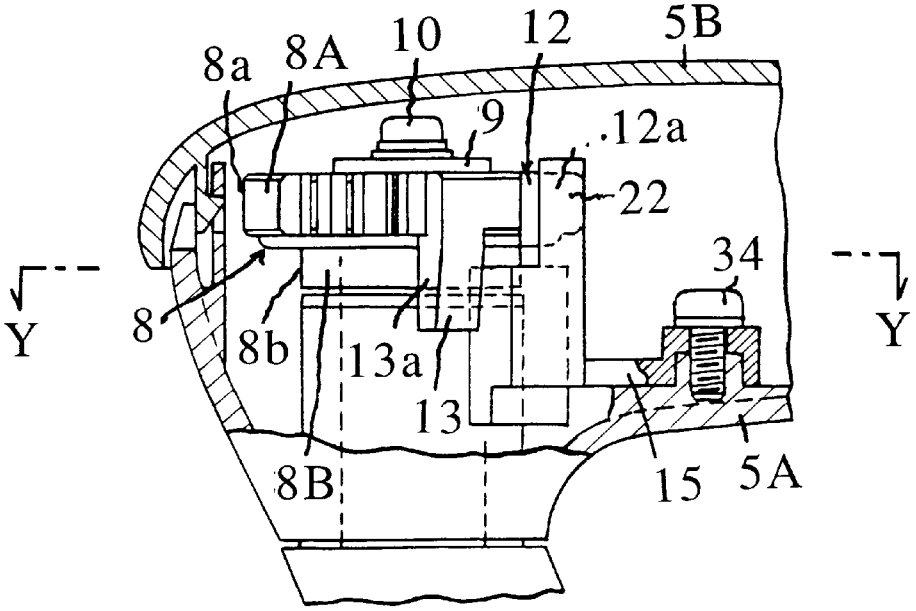
FIG. 4 is a partially cutaway view of a base portion of an armrest, from which a regulating piece is omitted.
Figure 5:
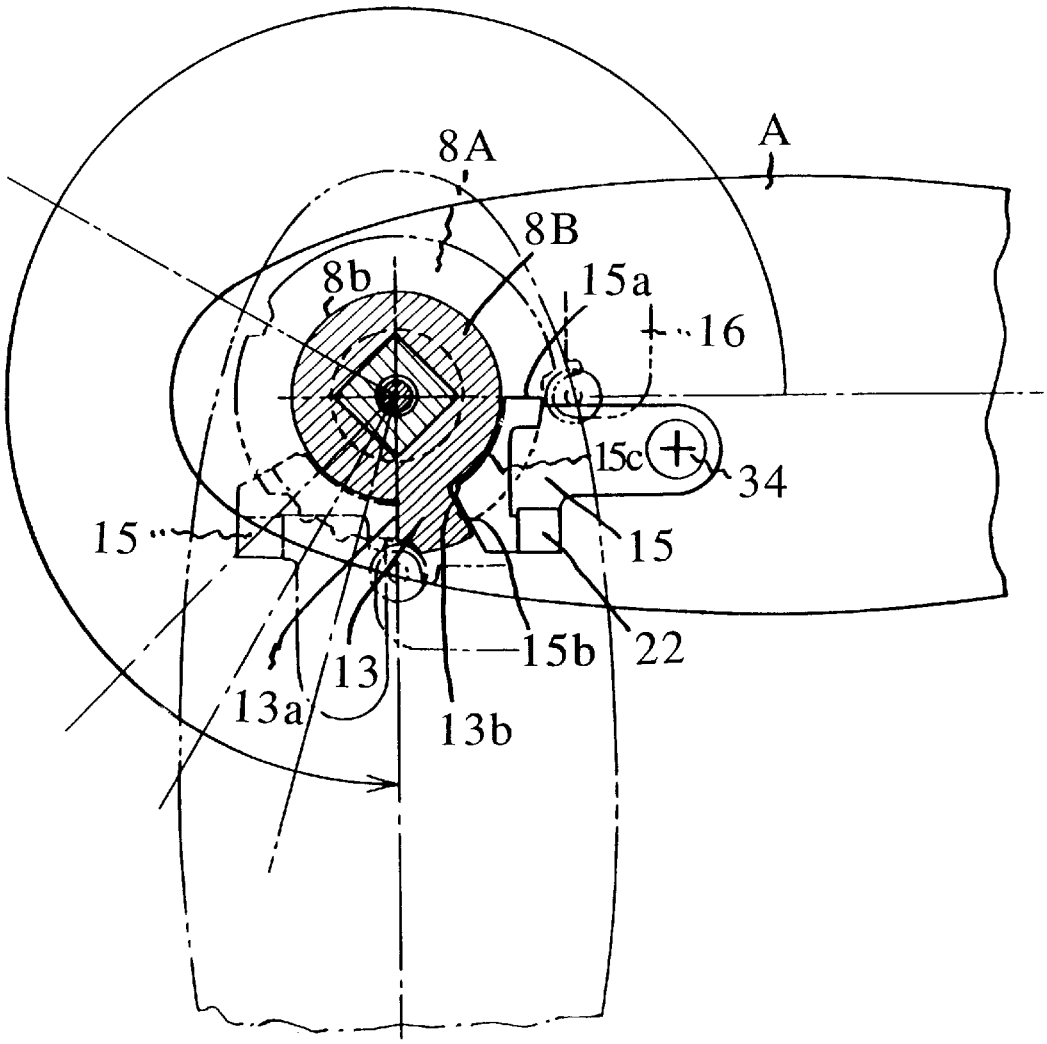
FIG. 5 is a sectional view taken on line Y—Y in FIG. 4.
Figure 6:
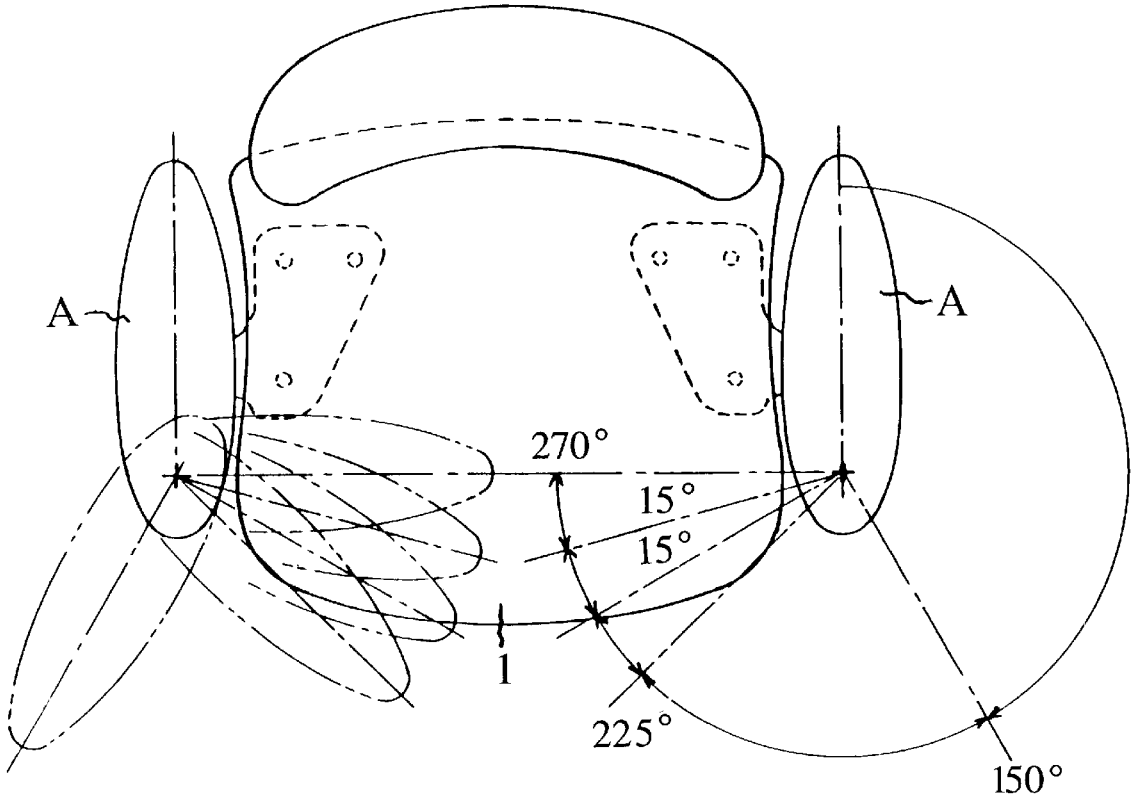
FIG. 6 is a view useful in explaining the operation of an armrest.

The invention will now be described in detail with reference to the drawings showing an armrest device for a chair according to an embodiment of the invention. FIG. 1 is a longitudinal section of an armrest device for a chair according to an embodiment of the invention, from which an engaging piece is omitted; FIG. 2 is a plan view of a main part of an armrest device for a chair according to the embodiment of the invention; FIG. 3 is a sectional view taken on line X—X in FIG. 2; FIG. 4 is a partially cutaway view of a base portion of an armrest, from which a regulating piece is omitted; FIG. 5 is a sectional view taken on line Y—Y in FIG. 4; and FIG. 6 is a view useful in explaining the operation of an armrest.

An armrest device of a chair comprises a support 2 uprightly disposed on a seat 1, and a column-like main shaft 3 uprightly disposed on an upper end of the support 2 and rotatably combined to an armrest A, whereby rotating the armrest A with the main shaft 3 as a center enables the rotational position of the armrest A to be freely set. The armrest A comprises an armrest main body 5, and a built-in armrest operating device in the armrest main body 5. The armrest main body 5 comprises a base frame 5A, and an armrest frame 5B combined to the base frame 5A so as to overlapping with the base frame 5A. This device will be described hereinbelow.

The armrest main body 5 comprises an attaching cylinder 6 disposed protrudingly to the inside of the armrest main body 5 at a proximal end portion of the base frame 5A constituting the armrest main body 5. The attaching cylinder 6 is rotatably combined to the main shaft 3 so as to be engaged with the main shaft 3, with the main shaft 3 inside, through a sleeve 7 inserted into the attaching cylinder 6. Accordingly, the attaching cylinder 6 is smoothly rotated due to the slidable-contact between the sleeve 7 (made of a resin) and the main shaft 3 (made of a resin).

A cylindrical guiding member 8 is engaged with an upper end of the main shaft 3 protruding from the attaching cylinder 6, with the guiding member 8 outside. The guiding member 8 is combined and then fixed on to an upper end of the main shaft 3 through a fastening screw 10 which is screwed into the main shaft 3 through a presser plate 9.

The guiding member 8 comprises a guiding portion 8A of a large diameter, and a second guiding portion 8B of a small diameter disposed below the guiding portion 8A. Outer circumferential surface of the respective guiding portions 8A, 8B constitute the guiding surfaces 8*a*, 8*b* as cylindrical surfaces formed with the main shaft 3 as a center. First to sixth receiving recess portions 11A, 11B, 11C, 11D, 11E, 11F are disposed at suitable locations of the guiding surface 8*a* of the guiding portion 8A. A notch 12 is disposed on the guiding portion 8A while extending from its upper surface to its lower surface 8A' near the first receiving recess portion 11A between the first receiving recess portion 11A and the sixth receiving recess portion 11F, that is, on the side of a distal end portion of the armrest A (armrest main body 5). A catching portion 13, which is a portion of the guiding portion 8B protruding from the guiding surface 8*b*, is disposed just below the guiding portion 8A at a portion between the notch 12 and the sixth receiving recess portion 11F.

The first receiving recess portion 11A is positioned at such an angular location as that the roller 14, described later, is to be engaged therewith when the armrest main body 5 is oriented substantially in parallel with the longitudinal direction of the seat 1, the second receiving recess portion 11B at an angular location of 150° from the first receiving recess portion 11A, the third receiving recess portion 11C at an angular location of 225°. The fourth to sixth receiving recess portions 11D, 11E, 11F are at angular locations of every 15° from the location of the third receiving recess portion 11C. That is, the roller 14 is selectively engaged with the receiving recess portions 11A, 11B, 11C, 11D, 11E, 11F, thereby causing the armrest main body 5 to be displaced through rotation (direction) angles as shown in FIG. 6, and then causing this state to be maintained.

When the roller 14 is disengaged with the receiving recess portions 11A, 11B, 11C, 11D, 11E, the armrest main body 5 is freely rotated with the main shaft 3 as a center between the pertinent receiving recess portions (e.g. the first receiving recess portion 11A and the second receiving recess portion 11B).

The catching portion 13 comprises a first catching edge 13*a* arranged on a proximal end portion of the armrest main body 5 and directed in the axial line of the guiding member 8, and a second catching edge 13*b* arranged on a distal end portion of the armrest main body 5 and directed in the axial line of the guiding member 8.

The first catching edge 13*a* is arranged at such a location as to overlap with the sixth receiving recess portion 11F as viewed from above, and is oriented in a direction perpendicular to the longitudinal direction of the armrest main body 5 when the armrest main body 5 is arranged in parallel with the longitudinal direction of the seat 1 (when the roller 14 is engaged with the first receiving recess portion 11A). One end surface 15*a* of the engaging piece 15, described later, is engaged with the first catching edge 13*a*, which prevents the armrest main body 5 from rotating from the first receiving recess portion 11A to the second receiving recess portion 11B, finally to the sixth receiving recess portion 11F (counterclockwise direction in FIG. 2, hereinafter referred to as the counterclockwise direction).

The second catching edge 13*b* is, as described above, disposed on the catching portion 13 on the distal end portion of the armrest main body 5, and is oriented substantially toward the other end surface 15*b* of the engaging piece 15 which is inclined to the one end surface 15*a* of the engaging piece 15. The other end surface 15*b* of the engaging piece 15 is engaged with the second catching edge 13*b*, which prevents the armrest main body 5 from rotating from the sixth receiving recess portion 11F to the fifth receiving recess portion 11E, finally the first receiving recess portion 11A (clockwise direction in FIG. 2, hereinafter referred to as the clockwise direction).

The roller 14 is supported rotatably around the longitudinal axis on a distal end portion of a swinging piece 16, and rolls, as described above, on the guiding surface 8*a* of the guiding portion 8A. The swinging piece 16, made of a frame body having a C-like section, rotatably supports the roller 14 through a roller shaft 17 at the distal end portion thereof, and rotatably (swingably in the horizontal plane) mounted on a supporting shaft 18 at a proximal end thereof, which supporting shaft is uprightly disposed on the base frame 5A constituting the armrest main body 5.

Moreover, the distal end portion of the swinging piece 16 may provided with a contacting portion, which is fixed to the swinging piece 16, instead of the roller 14, and further this contacting portion may be shaped into an arc, thereby causing the contacting portion to be smoothly moved on the guiding surface 8*a*.

Insofar as the contacting portion (including the roller 14) disposed on the distal end portion of the swinging piece 16 can be moved on the guiding surface 8*a* and then being engaged with each of the receiving recess portions 11A to 11F, any other construction may be employed.

A coil spring 19 is wound around the supporting shaft 18 rotatably supporting the swinging piece 16. This spring 19 is engaged with a segment 16*a* of the swinging piece 16 at one end thereof and engaged with a segment 20*a* of a supporting piece 20, which is disposed on the base frame 5A, at the other end thereof. The resilient force of the coil spring 19 swings (rotates) the distal end of the swinging piece 16 toward the guiding surface 8*a*, which causes the roller 14 rotatably supported on the distal end portion of the swinging piece 16 to be normally contacted to the guiding surface 8*a*.

The engaging piece 15 is fixed to the base frame 5A through a fastening screw 34 at a proximal end portion thereof. The above-mentioned one end surface 15*a* corresponds to one side surface of a distal end portion of the engaging piece 15, and the above-mentioned other end surface 15*b* corresponds to the other side surface which is oriented (inclined) at a predetermined angle to the one end surface 15*a*. An end face connecting the one end surface 15*a* and the other end surface 15*b* comprises an arc-like surface 15*c* (a part of a circle formed with the main shaft 3 as a center) which coincides of which curvature coincides with an arc of the guiding surface 8*b* of the guiding portion 8B, thereby preventing a portion between the distal end portion (arc-like surface 15*c*) of the engaging piece 15 and the guiding portion 8B from chattering, and causing the distal end portion of the engaging piece 15 including the arc-like surface 15*c* to be normally located below the guiding portion 8A of the guiding member 8, and further to be moved around the guiding portion 8B (on the guiding surface 8*b*) with the rotation of the armrest main body 5.

A seizing piece 22 is uprightly disposed on one end of the distal end portion of the engaging piece 15. The seizing piece 22 is located at such a location as to be opposed to one end edge 12*a* of the notch 12 with respect to the longitudinal direction of the armrest main body 5, when the armrest main body 5 is oriented in parallel with the longitudinal direction of the seat 1. A regulating piece 24 is combined to the base frame 5A in such a manner that its distal end portion 24*a* is engaged and disengaged with a gap 23 (FIG. 3) formed by the seizing piece 22 and the one end edge 12*a* of the notch 12. The regulating piece 24 comprises a main body 24*b*, and the distal end portion 24*a* arranged just above the engaging piece 15. The main body 24*b* arranged on the side of the distal end portion of the armrest main body 5 with respect to the swinging piece 16 is positioned between the supporting piece 20 disposed on the base frame 5A and a supporting piece 20' disposed on the base frame 5A so as to oppose to the supporting piece 20. The main body 24*b* is rotatably supported at an intermediate portion thereof by a lateral shaft 25 bridged between the supporting pieces 20, 20', and further is adapted to forcedly rotate the distal end portion 24*a* moved to above the armrest A due to the urging force of a coil spring 26. This spring 26 is wound around the lateral shaft 25, and engaged with a bottom of the regulating piece 24 at one end thereof and engaged with the base frame 5A at the other end thereof.

Moreover, the distal end portion 24*a* of the regulating piece 24 comprises an upper piece 24*a*', and a pair of side pieces 24*a*", 24*a*" arranged on both sides of the upper piece 24*a*, so as to be inclined while widening toward their lower ends. When the distal end portion 24*a* is, as shown in FIG. 3, engaged with the gap 23 formed by the one end edge 12*a* of the notch 12 and the seizing piece 22, the inclined side pieces 24", 24" are pressure-contacted to the one end edge 12*a* and the seizing piece 22, thereby preventing the regulating piece 24 from rotation-urged by the coil spring 26, and further, when the distal end portion 24*a* is moved to below the guiding member 8 with the rotation of the armrest main body 5, the upper piece 24*a*' of the distal end portion 24*a* is abutted to the lower surface 8A' of the guiding portion 8A, thereby preventing the rotation-urging, as is the case with the above-mentioned case.

A connecting rod 27 is disposed on rear end portions (distal end portion with respect to the armrest main body 5) of the side pieces 24", 24", constituting the main portion 24*b*, of the main portion 24*b* of the regulating piece 24. The connecting rod 27 penetrates through a horizontally extending slit disposed on an operating piece 29, which causes an intermediate portion of the connecting rod 27 to be connected to an upper portion of the operating piece 29. The operating piece 29 protrudes downward from the lower surface of the armrest main body 5 through an guiding cylinder portion 30 disposed on the base frame 5A which is located under the operating piece 29.

Then, FIGS. 1 and 2 show the armrest A (armrest main body 5) is oriented in parallel with the longitudinal direction of the seat 1, as is the case with FIG. 6. On this occasion, the distal end portion 24*a* of the regulating piece 24 is engaged with the gap 23 formed by the one end edge 12*a* of the notch 12 and the seizing piece 22 due to the urging force of the coil spring 26, as shown in FIGS. 2 and 3, thereby causing the urging force of the coil spring 26 to be regulated and then the counterclockwise rotation of the armrest main body 5 to be regulated. Moreover, the other end surface of the engaging piece 15 is engaged with the second catching edge 13*b* of the catching portion 13 disposed on the guiding member 8 and pressure-contacted to the seizing piece 22, thereby causing the clockwise rotation to be regulated.

The further reason why the distal end 24*a* of the regulating piece 24 is so constructed to be engaged with the gap 23 is to prevent the armrest main body 5 (armrest A) from chattering to the main shaft 3.

On this occasion, when a lower end of the operating piece 29 protruding from the lower surface of the armrest main body 5 (base frame 5A) is pressed, the operating piece 29 is raised against the urging force of the coil spring 26, and the connecting rod 27 is moved along the slit 28 disposed on the upper portion of the operating piece 29. As a result, the distal end portion 24*a* of the regulating piece 24 is rotated and lowered, and then separated from the gap 23, to thereby be located below the guiding portion 8A of the guiding member 8A (shown by a chain line in FIG. 1).

While holding the distal end 24*a* of the regulating piece 24 below the guiding member 8 by pressing the operating piece 29 by a fingertip, pressing the armrest main body 5 in the counterclockwise direction causes the armrest main body 5 to rotate with the main shaft 3 as a center, which causes the roller 14 to be disengaged with the first receiving recess portion 11A. Further, the distal end portion 24*a* of the regulating piece 24 is located below the lower surface 8A' of the guiding member 8, and hence the guiding member 8 regulates the distal end 24*a* of the regulating piece 24, which is urged by the coil spring 26, from returning to its initial height, which leads to a smooth rotating operation of the armrest main body 5 even if the fingertip releases the pressing of the operating piece 29.

Then, the roller 14 is normally contacted to the guiding surface 8*b* of the guiding portion 8A due to the operation of the coil spring 16; therefore, it is moved on the guiding surface 8*b* due to the rotating operation of the armrest main body 5 (Originally, the arc surface 15*c* of the engaging piece 15 is moved on the guiding surface 8*b* of the second guiding portion 8B of the guiding portion 8, preventing the chattering during moving.). Repeating the movement causes the roller 14 to be engaged with the second receiving recess portion 11B, or the third, fourth, fifth, and sixth receiving recess portions 11C, 11D, 11E, 11F in turn. When the roller 4 reaches any one of the receiving recess portions 11B to 11F, stopping the rotating operation of the armrest main body 5 causes the angular location (directional angle) of the armrest main body 5 in the longitudinal direction of the seat 1 to be set.

When the roller 14 is engaged with the sixth receiving recess portion 11F, the one end surface 15*a* of the engaging piece 15 is contacted to the first catching edge 13*a*, which causes the counterclockwise rotation of the armrest main body 5 to be regulated.

Rotating the armrest main body 5 in the clockwise direction causes the armrest main body 5 to return to the initial location. When it returns, the distal end 24*a* of the regulating piece 24 is engaged with the gap 23 again due to the urging force of the coil spring 26.

The base frame 5A and the armrest frame 5B constituting the armrest main body 5 are fixed to each other by the screw rod 31, a window disposed on the main body 24*b* of the regulating piece 24 serves to prevent the regulating piece 24 from interfering with the screwing cylinder 33 for the screw rod 31, disposed on the armrest frame 5*b*.

What is claimed is:

1. An armrest device for a chair, comprising:

a main body having a proximal end, a distal end, an upper surface, and a lower surface;

a support having an upper end;

an attaching cylinder having an upper end, said attaching cylinder being disposed on said main body;

a main shaft having an upper end, said main shaft being disposed uprightly on the upper end of said support and rotatable inside said attaching cylinder;

a guiding portion having a lower surface, said guiding portion being disposed on the upper end of said main shaft that protrudes from the upper end of said attaching cylinder;

a guiding surface disposed on said guiding portion along a circle formed with said main shaft as a center;

a swinging piece having a proximal end portion and a distal end portion, the proximal end portion of said swinging piece being rotatably mounted to said main body;

a first spring disposed so as to rotation-urge the distal end portion of said swinging piece toward said guiding surface;

a roller rotatably mounted to the distal end portion of said swinging piece and capable of rolling on said guiding surface; and receiving recess portions disposed at suitable locations of said guiding surface for engaging said roller.

2. An armrest device in accordance with claim 1, further comprising:

a notch disposed on said guiding portion so as to communicate with a portion of the lower surface of said guiding portion surrounding said main shaft;

a regulating piece having a first end, a second end, and an intermediate portion, the intermediate portion of said regulating piece being rotatably mounted to said main body about a horizontal axis;

a second spring for engaging the first end of said regulating piece with said notch; and an operating piece having an upper end portion, said operating piece protrudes from the lower surface of the distal end of said main body, the upper end portion of said operating piece being rotatably connected to the second end of said regulating piece.

3. An armrest device in accordance with claim 1, further comprising:

an engaging piece having two end surfaces, said engaging piece being mounted to said main body and superimposed to said lower surface of said guiding portion; and a receiving/supporting portion disposed below said guiding portion, said receiving/supporting portion having a first receiving/supporting edge for catching one end surface of said engaging piece so that said engaging piece moves around said guiding portion as said main body is rotated, and a second receiving/supporting edge for catching the other end surface of said engaging piece.

* * * * *